US011548115B2

(12) United States Patent
Nguyen

(10) Patent No.: US 11,548,115 B2
(45) Date of Patent: Jan. 10, 2023

(54) DRY WET BLAST MEDIA BLASTING SYSTEM

(71) Applicant: Phuong Taylor Nguyen, Richmond, TX (US)

(72) Inventor: Phuong Taylor Nguyen, Richmond, TX (US)

(73) Assignee: Axxiom Manufacturing, Inc., Fresno, TX (US)

( * ) Notice: Subject to any disclaimer, the term of this patent is extended or adjusted under 35 U.S.C. 154(b) by 0 days.

(21) Appl. No.: 15/876,331

(22) Filed: Jan. 22, 2018

(65) Prior Publication Data

US 2022/0241930 A1 Aug. 4, 2022

Related U.S. Application Data

(63) Continuation of application No. 15/417,546, filed on Jan. 27, 2017.

(51) Int. Cl.
*B24C 5/04* (2006.01)

(52) U.S. Cl.
CPC ..... *B24C 5/04* (2013.01)

(58) Field of Classification Search
CPC B24C 5/02; B24C 5/04; B24C 7/0046; B24C 7/0053; B24C 7/0061; B24C 7/0076; B24C 7/0084
See application file for complete search history.

(56) References Cited

U.S. PATENT DOCUMENTS 2,376,616 A * 5/1945 Oechsle ..... B24C 7/0084 451/101
4,728,205 A 3/1988 Hasumi et al.
4,765,540 A * 8/1988 Yie ..... B24C 5/04 239/467
4,768,709 A * 9/1988 Yie ..... B24C 5/02 239/336

(Continued)

FOREIGN PATENT DOCUMENTS

DE 102004023246 10/2005
WO 2018055012 3/2018

*Primary Examiner* — Joel D Crandall
(74) *Attorney, Agent, or Firm* — Kearney, McWilliams & Davis, PLLC; John M. DeBoer

(57) ABSTRACT

A wet media blasting system with a water injection system that provides more uniform distribution of the water, air and media components for achieving better application of the mixture while minimizing the amount of water required to contain and minimize or eliminate airborne particulate matter such as dust produced during the blasting operation. By more thoroughly mixing the water into the abrasive/water mix, the amount of water required is reduced. The abrasive feed is placed and shaped to optimize spray coverage and minimize abrasive flow into injection space thus mitigating water nozzle clogs. The abrasive flow is shaped as it is released from the metering valve in order to tighten the abrasive flow before it enters into the blast air stream. The shaped and tightened abrasive flow is maintained at the lower portion of the blast air stream. This positions the abrasive flow in optimum placement for spray wetting the abrasive as it flows into and through the nozzle. This also mitigates nozzle clogging by directing most of the abrasive flow away from the water spray nozzle port.

14 Claims, 12 Drawing Sheets

(56) References Cited

U.S. PATENT DOCUMENTS

| | | | | | |
|---|---|---|---|---|---|
| 4,821,467 | A * | 4/1989 | Woodson | B24C 7/0084 | 451/99 |
| 5,018,670 | A * | 5/1991 | Chalmers | B24C 5/04 | 239/433 |
| 5,054,249 | A * | 10/1991 | Rankin | B24C 7/0053 | 451/99 |
| 5,201,150 | A * | 4/1993 | Kuboyama | B24C 7/0038 | 451/100 |
| 5,407,379 | A * | 4/1995 | Shank | B24C 7/0069 | 451/99 |
| 5,857,900 | A * | 1/1999 | Shank, Jr. | B24C 5/04 | 451/90 |
| 6,168,503 | B1 * | 1/2001 | Pao | B24C 5/04 | 451/38 |
| 2009/0130959 | A1 * | 5/2009 | Mase | B24C 7/00 | 451/38 |
| 2016/0236323 | A1 * | 8/2016 | Mase | B24C 1/08 | |

* cited by examiner

DRY WET BLAST MEDIA BLASTING SYSTEM

CROSS-REFERENCE TO RELATED APPLICATIONS

This application is a continuation of co-pending application Ser. No. 15/417,546, entitled: "Dry Wet Blast Media Blasting System", filed on Jan. 27, 2017, inventor: Phuong Taylor Nguyen. That application is incorporated by reference herein and all information disclosed in that application is to be treated as if fully disclosed herein.

BACKGROUND OF THE INVENTION

Field of the Invention

The invention is related to media blasting systems and is specifically directed to wet media blasters.

Discussion of the Prior Art

Traditional media blasting systems use dry blast media which is stored in a bulk tank or pot with an outlet for introducing the media into a media control valve or metering valve. The metering valve is also connected to a source of pressurized air whereby blast media is mixed into the air stream. The blast media and air stream mix is then propelled through a nozzle and directed onto a work surface. Systems of this design are well known and widely available. One such source of traditional dry media blasting systems is Axxiom Manufacturing, Inc. of Fresno, Tex., which offers the Schmidt brand blasting equipment.

Dry media blasting systems have proven to be very effective in media blast operations and have been in operation for over 100 years. However, such systems do release the blast media or dust into the surrounding area during operation. This is not an issue in some applications but there are many circumstances where dust containment or suppression is desirable or required.

Wet media blasters have been created to minimize the generation of airborne media particles in blasting operations. In a broad sense, such systems are basically units that combine water and abrasive and release the combination into a stream of pressurized air through a nozzle, whereby the solution can be blasted at a work surface under high pressure. When water is mixed in with the abrasive, the dust is contained in water droplets and does not become airborne but is collected at the base of the surface being blasted.

In industrial applications, there are two types of wet media blasting systems. In the first, water is mixed in with the media in the media storage tank. The mixture of media and water is then released, i.e., introduced, into a pressurized air flow and directed to a release nozzle. In the second, the abrasive media and air are mixed upstream of a water injection system located at the inlet port of the release nozzle. Water is injected into the abrasive/air mix upstream of the point where the abrasive/air mix enters the release nozzle. Both systems are effective in reducing the presence of airborne dust during operation.

However, there is a need for a system which more evenly mixes the abrasive/air/water mixture to improve blasting results and reduce the amount of water required to achieve the correct mix. It would also be desirable to control the air pressure and the water pressure to achieve a properly balanced system.

SUMMARY OF THE INVENTION

The subject invention is directed to a wet media blasting system with a unique water injection system that provides more uniform distribution of the water, air and media components for achieving better application of the mixture while minimizing the amount of water required to contain and minimize or eliminate airborne particulate matter such as dust produced during the blasting operation. Also, by more thoroughly mixing the water into the abrasive/water mix, the amount of water required is reduced.

Abrasive selection is typically the most difficult decision related to the blast operation. Choice of abrasive is based on factors such as blast application type, desired finish and coating requirements, characteristics of object to be blasted, cost and ability to recycle, available equipment, safety, and environmental constraints. There are many abrasives available that are either natural, manufactured, or processing by-products. Abrasives are available in varying sizes, shapes, and hardness. These characteristics determine the resulting effect on the surface to be blasted and limitations of its use. The effects on the blasted surface are measured by its degree of cleanliness and the surface profile.

In accordance with the subject invention, the abrasive feed is placed and shaped to optimize spray coverage and minimize abrasive flow into injection space thus mitigating water nozzle clogs. The abrasive flow is shaped as it is released from the metering valve to tighten the abrasive flow before it enters the blast air stream. The shaped and tightened abrasive flow is maintained at the lower portion of the blast air stream. This positions the abrasive flow in optimum placement for spray wetting the abrasive as it flows into and through the nozzle. This also mitigates nozzle clogging by directing most of the abrasive flow away from the water spray nozzle port.

Water injection shape, radial orientation, and longitudinal angle of water injection optimize wetting of the abrasive, lowers pressure drop, and mitigates clogging. The water spray is placed downstream of but in close proximity to the abrasive-air mixing point. This permits easier wetting of abrasive before full velocity is achieved. The water spray nozzle is placed inside a port or conduit that intersects the blast air-line at an oblique angle rather directly perpendicular to the abrasive flow. The water spray angle follows general direction of blast air flow for efficiency.

The angle spray port is smaller in diameter than the blast air conduit in order to use the flow to keep the abrasive from contacting the spray nozzle. The blast air flow keeps the grit and dust away from the nozzle, minimizing or even eliminating the tendency to clog the spray nozzle. The spray nozzle is placed sufficiently within the spray port to further decrease the likelihood of abrasive contact with the water spray nozzle. The radial orientation of the water spray nozzle relative to the abrasive feed orientation allows optimum effectiveness for wetting the abrasive.

Air quality is also a crucial factor in the operation of an abrasive blaster. Moisture and contaminants can cause components to malfunction. Moisture condensation in a blast system causes abrasive flow problems. Condensation occurs when the hot vapor-filled compressed air cools as it reaches the abrasive blaster. Water droplets formed during condensation can be absorbed by the abrasive in the blast vessel which can cause erratic flow to the abrasive valve. To minimize the chance of abrasive flow problems a moisture removal device installed for the blast system air supply is highly recommended, for example, a coalescing moisture separator, air-cooled aftercooler, deliquescent dryer, or the like.

Two additional unique features of the invention are the development of a new water injection delivery system and a control system that permit better control of the air/water mix during operation. In the subject invention, the water pressure can be regulated, as well as the air pressure. This assures that the differential pressure between air pressure and water pressure can be accurately monitored and controlled. One advantage of this system is the ability to perform four separate operations using the same delivery and mix system and the same release nozzle. The customary wet blast operation can be performed using the air/media/water mixed controlled to the desired combination and pressure. Where desired, the media flow may be cut off, permitting a media free water rinse. In addition, the water may also be cut off, permitting the use of the pressurized air flow to function as a blower and/or dryer. The system may also be used in the standard dry blast mode by shutting off the water shower.

The water injection system is unique and novel in that instead of providing uniform media flow past the injector, the media flow is partially deflected away from the water outlet, permitting the water to flow into and more fully saturate the release nozzle flow channel. This promotes more uniform mixing of the media and water and has the added advantage of creating a space between the water injector nozzle and the dry media, reducing the tendency to clog the nozzle, particularly at low pressure operation when the media can back flow toward the water injector nozzle. Specifically, a media release orifice plate is provided at the junction between the metering valve and the main air flow line for directing the media flow away from the water injector nozzle. This keeps the nozzle from being clogged and provides more clear space in the injector unit for better distribution of the water.

The water spray chamber feature prevents gravity backflow to abrasive feed port. The taper internal diameter or the step up internal diameter are placed upstream of the water injection point and downstream of the abrasive feed port. Specifically, the internal diameter (ID) of the blast air port where the abrasive is fed is smaller than the ID of the blast air port where the water is injected. The enlarged ID of the blast air port is then maintained downstream through the blast hose. This prevents residual water from flowing upstream to where the abrasive is introduced into the blast air stream which would eventually wet and stop the abrasive flow altogether.

A differential pressure gage is positioned between water pressure and blast air pressure to indicate, quantify, and control water flow. The ability to have consistent, adjustable, and repeatable water flow control with a simple operation is a significant advantage over prior art systems. In the exemplary embodiment, the differential pressure indicator is positioned to measure the difference between the water pressure and blast air pressure, since water injection cannot be achieved unless the water pressure is greater than the blast air pressure. Typically, the spray nozzle is a fixed orifice, and water flow rate is proportional to how much the water pressure is greater than the blast air pressure. The differential pressure gage reading provides the operator with a visual indication of water volume flow rate. In addition, a water pressure regulator is provided for permitting the operator to adjust the water pressure. The pressure differential indicator and the water pressure regulator, in combination, provide the operator with the means to consistently and repeatedly control the water flow rate. Manually variable water flow is important because each operator will adjust the water flow according to the abrasive type, abrasive size, abrasive flow rate, dust content, and blast pressure.

An additional feature of the invention is the inclusion of a washdown circuit. After wetblasting, the surface is usually left with residual abrasive. This requires a rinse to wash the abrasive off the surface. The water flow rate for washdown is significantly higher than the water flow rate during blasting, which is usually for dust control.

Another additional feature is a blowoff function using the using compressed air to blow dry and ready the blasted surface for painting. This feature basically allows two settings of air pressure. One is for blasting which is generally greater than 80 psig. The washdown and blowoff would be at a much lower air pressure approximately 35 psig. This is achieved by allowing the operator to quickly select either pressure setting. If the water pressure regulator setting constant, significantly lowering the regulated air pressure will concurrently increase the water flow rate; thereby quickly creating a washdown mode. If the water flow is shutoff, this creates a lower pressure blowoff mode also. The washdown/blowoff circuit consists of two pilot air regulators and a slave regulator. A high-pressure blast pilot regulator and a washdown/blowoff pilot regulator are each ported to the much larger and higher flow slave regulator. A three-way valve is placed between the two pilot regulators and slave regulator to allow the operator to manually select which pilot regulator controls the slave regulator.

The system of the subject invention can be configured as a portable unit or as a stationary system, maximizing adaptability to various operations. The portable unit is equipped with handles and wheels and can be rolled to locations where blast jobs are remotely performed. The stationary unit is designed to be installed in a permanent location and may be installed below an abrasive hopper, removing the need to have an abrasive hopper mounted on the unit and also increasing capacity. Multiple blast nozzles may be utilized, as determined by the compressed air requirements for each application. The blast nozzle size and blast pressure determine the compressed air requirements. Air compressor size is also determined by each application. Single outlet and multiple outlet units are supported.

The blast system of the subject invention provides the capability to deliver a mixture of wet abrasive and compressed air to a blast nozzle. The abrasive blast stream through the blast nozzle is used for removing rust, paint, or other unwanted surface defects. After abrasive blasting, the surface may be washed off and blown dry before it is ready for new paint or coating. Typically, the abrasive blaster of the system is one of a group of components used in an abrasive blasting job. The typical components are an air compressor, moisture removal device, an abrasive blaster, blast hose, a blast nozzle, operator personal protective equipment, and blast abrasive. The blast abrasive is loaded into the abrasive blaster through the abrasive inlet at the top of the blaster. All the compressed air must be removed from inside the abrasive blaster before it can be filled with abrasive. The abrasive can be bag loaded, or loaded from a storage hopper. To begin blasting, the abrasive inlet is closed, and the abrasive blaster is filled with compressed air from the air compressor.

Since moisture creates problems in the blast operation, it is common for the compressed air to be fed through a moisture removal device. The air pressure in the abrasive blast vessel is equal to the air pressure in the blast hose where it connects at the metering valve. This equal pressure is needed to allow the blast abrasive to flow downward by gravity. The abrasive flow is controlled by the metering valve at the bottom of the blaster. From the metering valve the blast abrasive flows into the blast air stream where it is injected with water. The mixture of wet abrasive and air then flow through the blast hose. The speed of blast air and wet abrasive mixture is greatly increased by the blast nozzle onto the work surface. The high speed of the air and abrasive is what gives it the energy to blast rust and paint off surfaces.

DETAILED DESCRIPTION OF THE ILLUSTRATED EMBODIMENT

Figure 1:
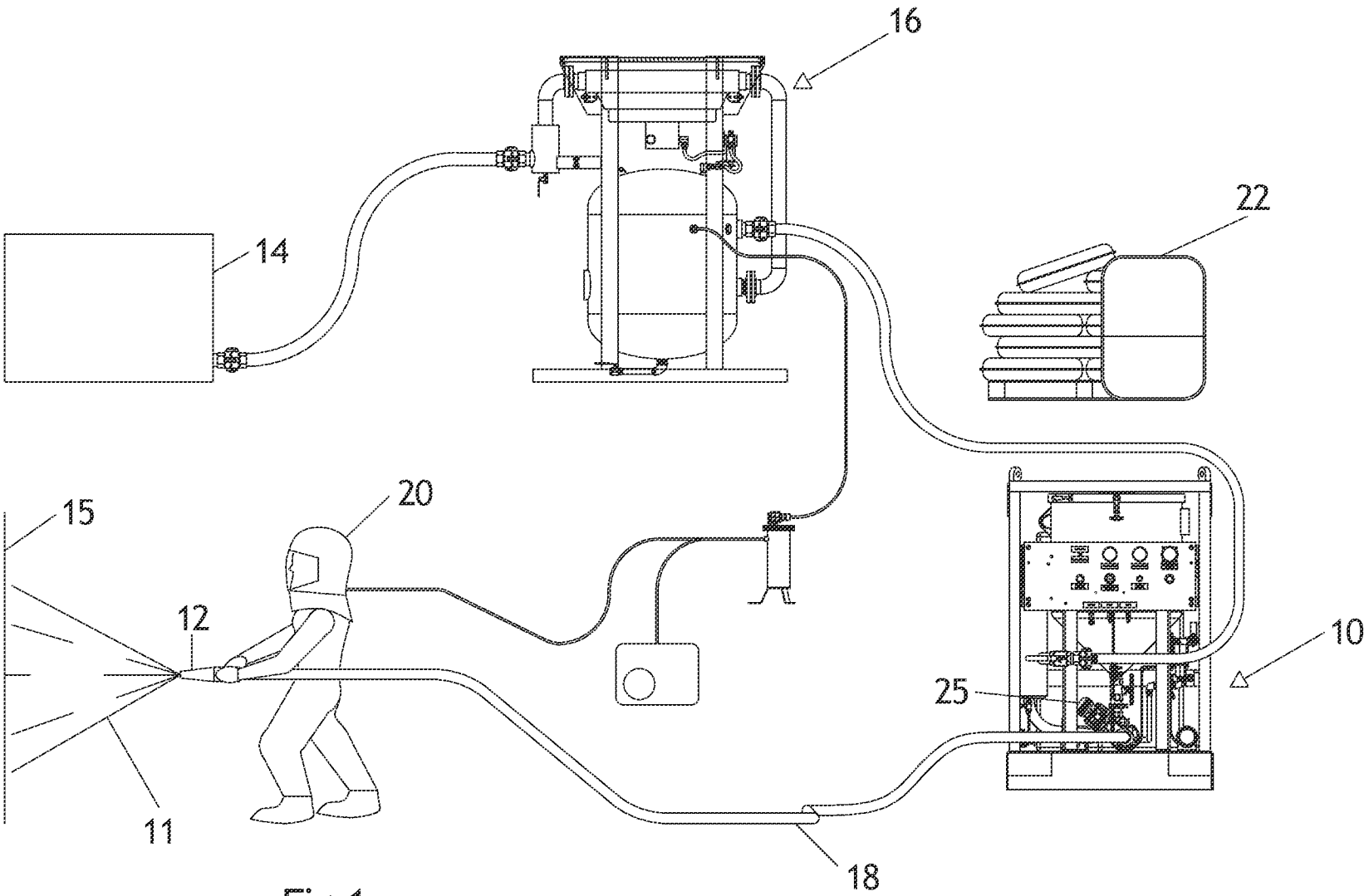
FIG. 1 is a diagrammatic view of a complete stationary abrasive blast system incorporating the wet/dry unit of the subject invention.

The subject invention is directed to a multi-functional wet dry blast system of the type having a source of pressurized air and a source of water providing air flow and water flow for carrying an abrasive media through a conduit such as a blast hose for mixing the abrasive with the pressurized air and the water creating a wet abrasive media mix for wet blasting a surface. The system includes a blast hose for delivering the wet abrasive mix, a blast nozzle for releasing the delivered wet abrasive mix to a work station, i.e., a surface to be treated, a source of pressurized air for delivering pressurized air to the blast hose upstream of other components of the wet abrasive mix, a source of abrasive media downstream of the pressurized air in the flow conduit, and a source of pressurized water located downstream of the source of abrasive media, whereby the abrasive media is introduced into the pressurized air in the flow conduit before the pressurized water is introduced. The system includes a valve and regulator control system for selectively disabling the source of water such that the mixture of pressurized air and abrasive media is delivered to the nozzle in a dry mix. In addition, the system supports disabling the source of abrasive media such that the pressurized water and air is delivered to the nozzle as pressurized water source for providing a water washdown for the system. A regulator system controls flow through the network and includes at least one differential pressure gage positioned between and in communication with the water pressure source and the air pressure source for monitoring and controlling water flow, and for monitoring the water pressure is relative to the air pressure to protect against backflow of water and media into the pressurized air source. This is to assure that the water pressure is greater than the air pressure.

The abrasive media is introduced into the flow conduit and into the flow of pressurized air downstream of the source of pressurized air and upstream of the source of water. The abrasive injection system includes a dam or gate restrictor for directing and tightening the flow of abrasive media along a lower portion of the flow conduit. A water source is provided downstream of the restrictor for providing a water shower for wetting the abrasive media as it flows through the flow conduit.

The preferred embodiment of the invention can be configured to operate in any one of four separate modes: (a) a first mode wherein the media delivery system, air flow and the water flow are both activated to provide a wet abrasive mixture for wet blasting, (b) a second mode wherein only the media delivery system and air flow are activated to provide a dry abrasive delivery for dry blasting, (c) a third mode wherein only the air flow is activated to provide a drying system; and (d) a fourth mode wherein only the water flow is activated to provide a water rinse.

The system includes an elongated, substantially cylindrical conduit or blast hose having one end coupled to an air injector system and the other end coupled to a blast nozzle. The air injector system is adapted for supplying pressurized air flow flowing from said one end toward and out the nozzle at said other end. The media delivery system is configured to introduce media into the conduit and into the air flow downstream of said one end, with the water delivery system adapted for introducing water into the air/media mix downstream of the media delivery system for generating a wet media mix for release at the nozzle for providing a wet blasting mix.

The media delivery system includes a restrictor for directing the injected media to a predefined area of the conduit to provide more clear space for the injected water permitting the water to flow into and more fully saturate the released water into and more fully saturate the conduit cross-section. The water inlet chamber is positioned outside of the conduit and in communication therewith. The water release nozzle is in the chamber, whereby the water release nozzle is spaced from and does not come in direct contact with the interior of the conduit, further protecting against clogging. In the preferred embodiment the water inlet chamber is on an oblique angle relative to the conduit with the water release end of the inlet chamber skewed toward the downstream flow of the conduit, minimizing backflow from the conduit flow path into the water release system.

The interior cross-sectional area of the conduit has a larger interior diameter at the nozzle end and a smaller interior diameter at the air flow injection end, further reducing the likelihood of backflow. In addition, the interior diameter of the conduit at the release point of the water delivery system is larger than the interior diameter of the conduit at the air injector end to further reduce the likelihood of back flow of media into the water delivery system.

The illustrated system of FIGS. 1-4 shows the wet/dry system 10 of the invention as adapted for providing a mixture of wet abrasive and compressed air to a blast nozzle 12. The abrasive blast stream 11 through the blast nozzle 12 is used for removing rust, paint, or other unwanted surface defects. After abrasive blasting, the same system 10 is used to wash off and dry the treated surface before it is ready for new paint or coating. The abrasive blaster 10 is one of a group of components used in an abrasive blasting job. The typical components are an air compressor 14, moisture removal device 16, the abrasive blaster 10, blast hose 18, the blast nozzle 12, operator personal protective equipment 20, and blast abrasive 22. The blast abrasive 22 is loaded into the abrasive blaster vessel 1 through the abrasive inlet 24 in the blaster 10. All the compressed air must be removed from inside the abrasive blaster vessel 1 before it can be filled with abrasive. The abrasive 22 can be bag loaded, or loaded from a storage hopper.

To begin blasting, the abrasive inlet 24 is closed and the abrasive blaster vessel 1 is filled with compressed air 6 from the air compressor 14 (FIG. 1). Since moisture creates problems in the blast operation, it is common for the compressed air to be fed through a moisture removal device 16. The air pressure in the abrasive blast vessel 1 is equal to the air pressure in an abrasive flow conduit section 114 (see FIG. 5) where it connects at the metering valve 25. This equal pressure is needed to allow the blast abrasive 22 to flow downward by gravity. The abrasive flow is controlled by the metering valve 25 at the bottom of the blaster vessel 1. From the metering valve 25 the blast abrasive 22 flows into the blast air stream where it is injected with water 17. The mixture of wet abrasive and air then flow together as a wet abrasive media mix 11 into and through the blast hose 18. The speed of blast air and wet abrasive mixture is greatly increased by the configuration of the blast nozzle 12 and is directed onto the work surface 15. The high speed of the air and abrasive is what generates the energy to blast rust and paint off surfaces. All blast operators should use personal protective equipment 20 during the blast operation.

Figure 2:
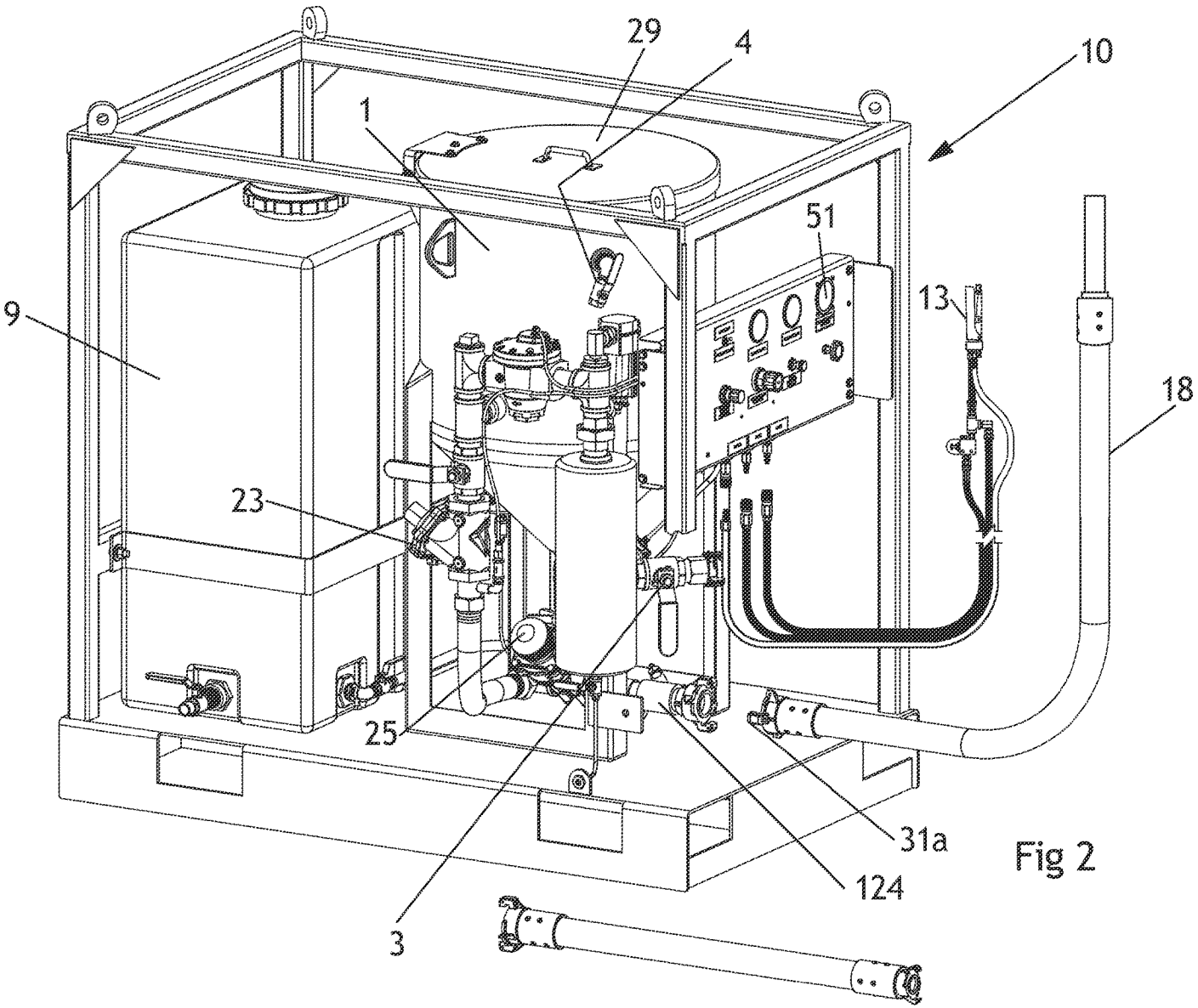
FIGS. 2 and 3 opposite perspective side views illustrating the components of the wet/dry blaster unit of the subject invention.
Figure 3:
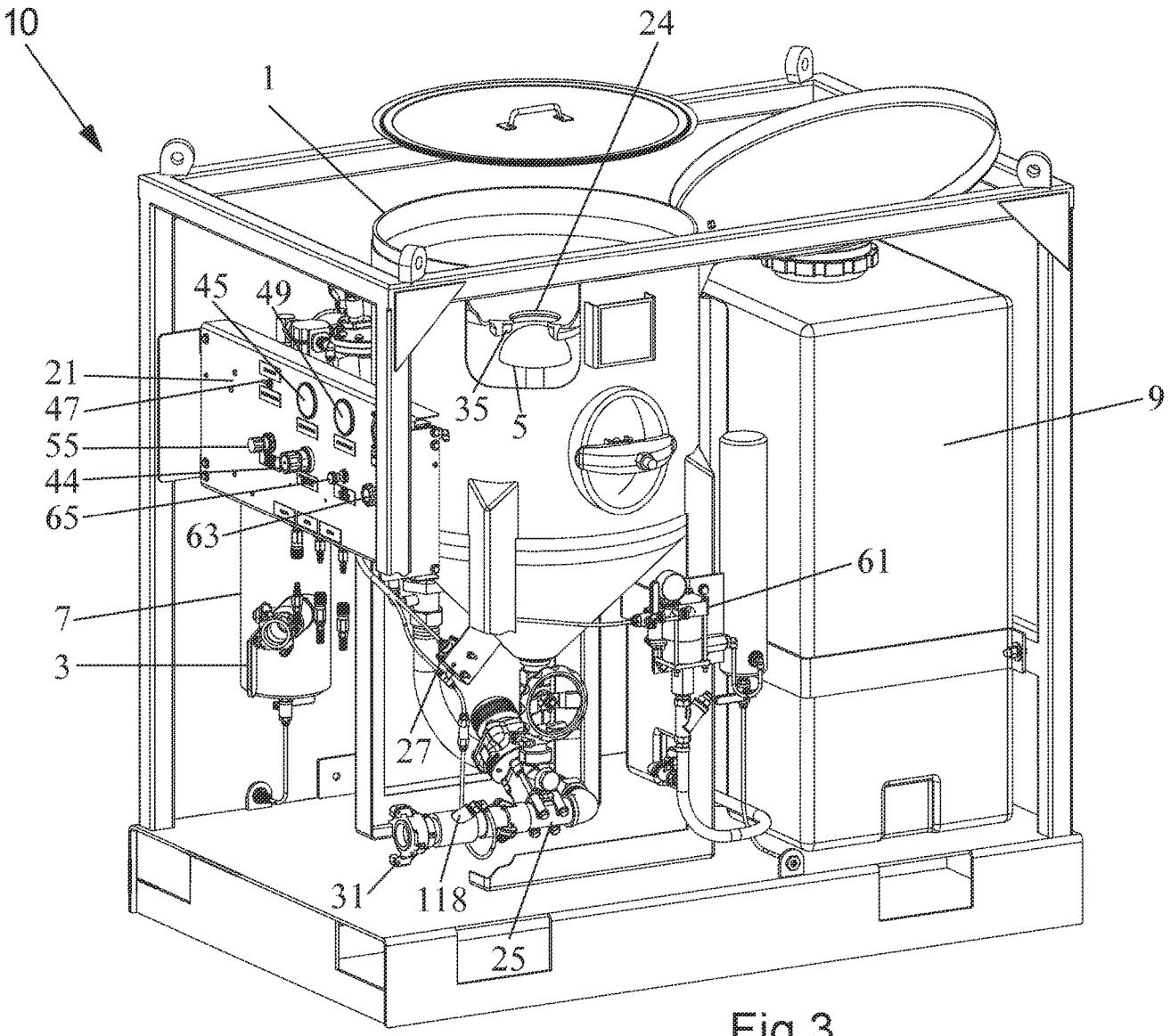
Figure 4:
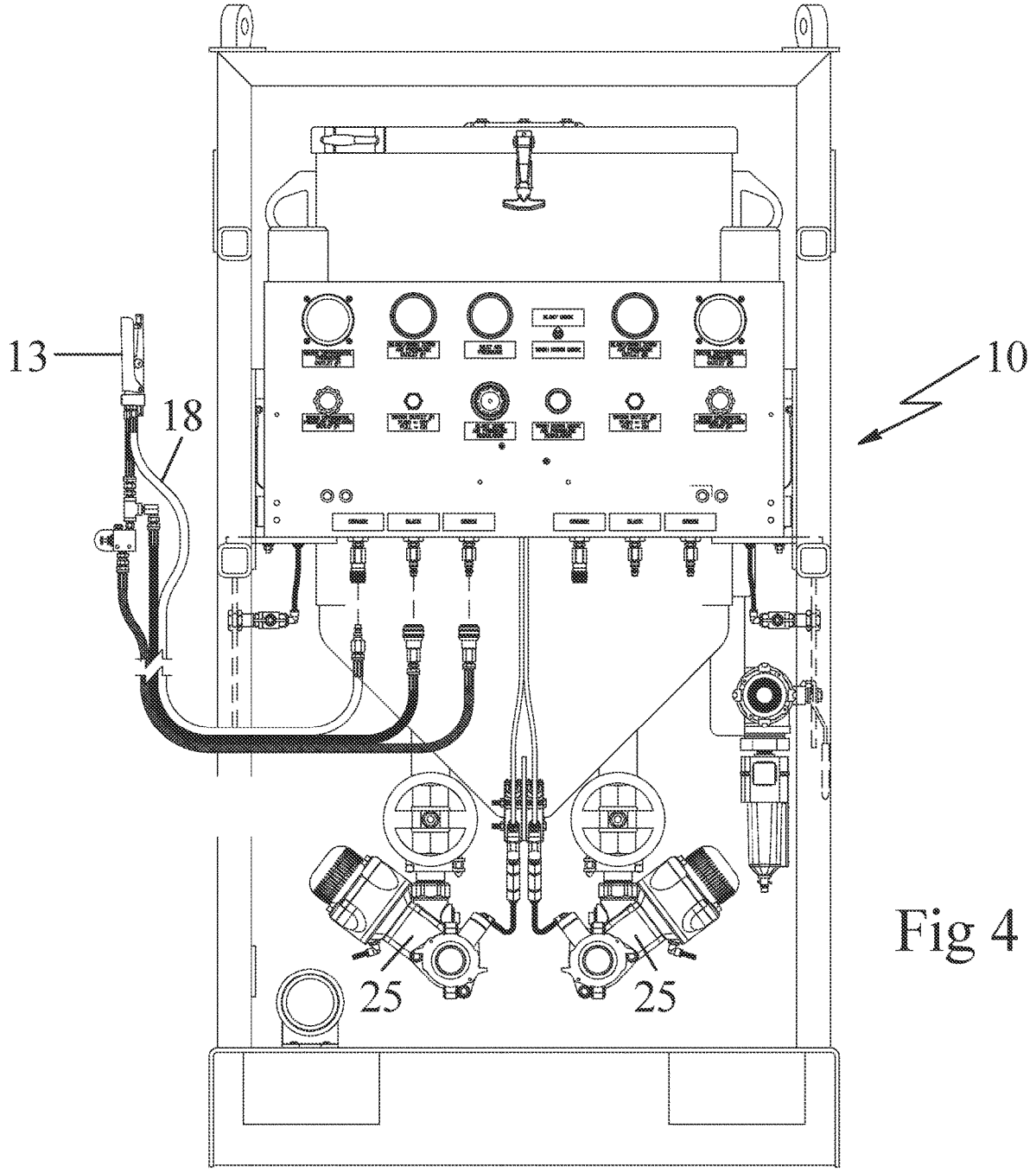
FIG. 4 is a front view of the control panel.

FIGS. 2 and 3 are perspective views of opposite sides of the blaster system 10, illustrating the components of the wet/dry blaster unit of the subject invention. As shown in FIG. 3, the abrasive blaster vessel 1 1 will pressurize when the blowdown ball valve 4 is closed and the air inlet ball valve 3 is opened. The compressed air flows through the moisture separator 7 to the blast outlet piping and into the abrasive blast vessel 1, when used. The air flow into the blast vessel internal piping will push the pop-up valve 5 against the popup gasket 35. This will seal the abrasive inlet which allows the air flow to fill and pressurize the abrasive blast vessel 1.

Blasting starts when the deadman lever 13 is pressed down which will pneumatically or electrically open the blast control valve 21 (or more if multiple outlets are supported). When the control valves open, it sends an air signal that simultaneously opens the automatic air valve 23, the metering valve 25 and the water shut-off valve 27. Compressed air will pressurize the blast hose 18 when the automatic air valve 23 is opened. At the same time, the metering valve 25 and water shut-off valve 27 will open allowing abrasive (22, FIGS. 5-6) to fall through and water 7 to be injected into the blast air stream 6. The abrasive flow can be increased or decreased by turning the knob on top of metering valve 25, in the manner well-known to those skilled in the art.

Blasting stops when the deadman lever 13 is released. This will close the blast control valves 21 and/or others and vent the air signal to the automatic air valve 23, the metering valve 25 and water shut-off valve 27. When the signal air vents, all the valves spring return into their "normally closed" position. The abrasive blaster 1 remains pressurized when the automatic air valve 23, metering valve 25 and water shut-off valve 31 are closed.

The abrasive blaster vessel 1 is depressurized by closing the air inlet ball valve 3 and then opening the blowdown ball valve 4 to completely vent the compressed air. The mode selector 47 (FIG. 3) allows the operator to quickly switch back and forth between blast pressure and wash down pressure without having to adjust the pressure settings. The mode selector is moved to the up position for blasting and is moved down for wash down.

In order to blast objects that are fragile it is necessary to reduce the blast air pressure. The blast pressure regulator 44 is used to adjust the blast pressure while in "BLAST MODE". The blast pressure is shown by the blast pressure gauge 49. The adjustment should be made while blasting so the effects are visible. To adjust the blast pressure, the regulator knob is pulled out to unlock it. Turn the knob clockwise to increase pressure and counter clockwise to decrease pressure. When the desired pressure is reached, push the knob in to lock it and prevent accidental changes.

The wash down pressure regulator 55 (FIG. 3) is used to adjust the blast pressure while in "WASH DOWN MODE". The wash down pressure is shown by the blast pressure gauge 49. The adjustment must be made while blasting so the effects are visible. To adjust the wash down pressure, pull the regulator knob out to unlock it. In the illustrated embodiment, the knob is turned clockwise to increase pressure and counter clockwise to decrease pressure. When the desired pressure is reached, push the knob in to lock it and prevent accidental changes. The recommended starting wash down pressure is 50 psi, with adjustments to achieve the desired results.

The inlet pressure gauge 45 shows the air pressure supplied by the air compressor. This gauge makes it possible to easily troubleshoot an insufficient air supply. If the pressure on the inlet pressure gauge 45 drops while blasting, then the air supply is insufficient for the nozzle size and blast pressure combination being used. This is especially critical on two outlet units. Fluctuations in the blast pressure will make it impossible to maintain consistent water differential pressure. There are three ways to correct the problem, 1) change to a larger air compressor, 2) change to a smaller nozzle or 3) reduce the blast pressure until no pressure drop is observed on the inlet pressure gauge.

The water pump 61 uses compressed air to create a pressurized water source that is injected into the blast stream as it passes through the injection module. The water pressure is controlled by a water differential pressure regulator 63. The water differential pressure regulator 63 allows adjustments of the water pressure in relationship to the blast pressure. In operation the water pressure needs to be higher than the blast pressure. The difference in pressure can be seen on the water differential pressure gauge 51. The adjustment must be made while blasting so the effects are visible. To adjust the water differential pressure, turn the knob clockwise to increase pressure and counter clockwise to decrease pressure. It is recommended to start at ten psi of differential pressure and then fine-tune to achieve the desired results.

The water on/off palm button control valve 65 is used to change between wet blast and dry blast. Pull the palm button out ("ON" position) for wet blast and push the palm button in ("OFF position) for dry blast. When the water on/off palm button control valve is in the "OFF" position, it stops the air signal to the water shut-off valve 27 preventing the water from turning on. The water control valve 27 is a normally closed valve that opens to inject water into the blast stream.

The water control valve opens when it receives air to its signal port. This happens when the deadman lever 13 is pressed down which opens the blast control valve sending an air signal to the water shut-off valve. When the deadman lever is released, the air signal from the blast control valve vents and the water shut-off valve closes to stop the flow of water.

The water injection module 124 (FIG. 2) is where water is introduced into the blast stream. The injection module 124 holds the water spray nozzle 118 in the optimum position to wet the abrasive in the blast stream as it exits metering valve 25.

When utilized in a multiple outlet mode, each blast outlet of dual outlet blast vessels operates as detailed for a single mode operation.

Referring now to FIGS. 5-9, the delivery system for the media/air/water mix assembly includes a typical abrasive metering valve 25 (shown here in block form, for a detailed view see FIGS. 8 and 9), a tank or pot 1 for storing the abrasive, a media release orifice 112 proximate to an abrasive release conduit 114, a source of pressurized air 14 connected to the release conduit 114 and a pressurized water source 61 in communication with a typical media nozzle 12. In the exemplary embodiment, the abrasive release conduit 114, water injection conduit 124 and the media nozzle tip 134 are separate units coupled together on a common center line. This specific configuration is a matter of choice well within the purview of those skilled in the art. The essential novel elements are the location of the abrasive release orifice 112 downstream of the air source 14 and upstream of the location of the water injection nozzle 118.

An important feature of the invention is the media release orifice 112, which is substantially upstream of the water spray at port 123. In addition, the media release orifice 112 is configured and shaped to direct released media 22 toward and along the bottom surface 128 of the flow conduit(s) 114 and 124. The half circle configuration has been shown to work well in practice, but other shapes and configurations could be utilized based on application and operator choice. This abrasive release system directs the abrasive stream to the bottom wall 128 of the delivery conduit(s) and provides a relatively clear air flow above the abrasive as shown at 130. As flow continues from the water injection conduit 124 the wet abrasive media mix 11 expands to fill the blast hose 18 as depicted at 132, upstream of the blast nozzle 12 and the blast nozzle tip 134.

Figure 6:
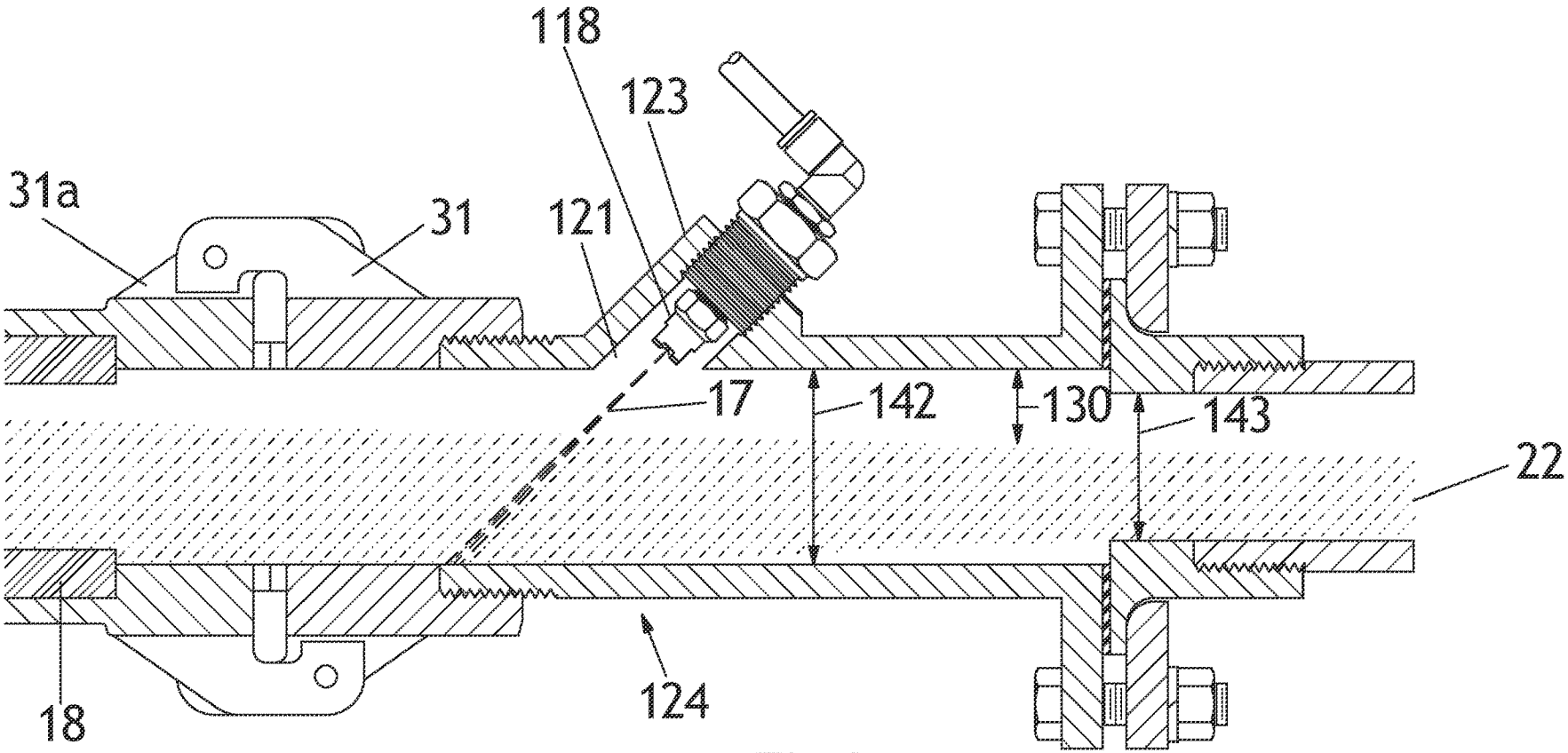
FIG. 6 is an enlarged, partial sectional view looking in the same direction as FIG. 5, with a stepped-up diameter flow chamber in the release nozzle.
Figure 7:
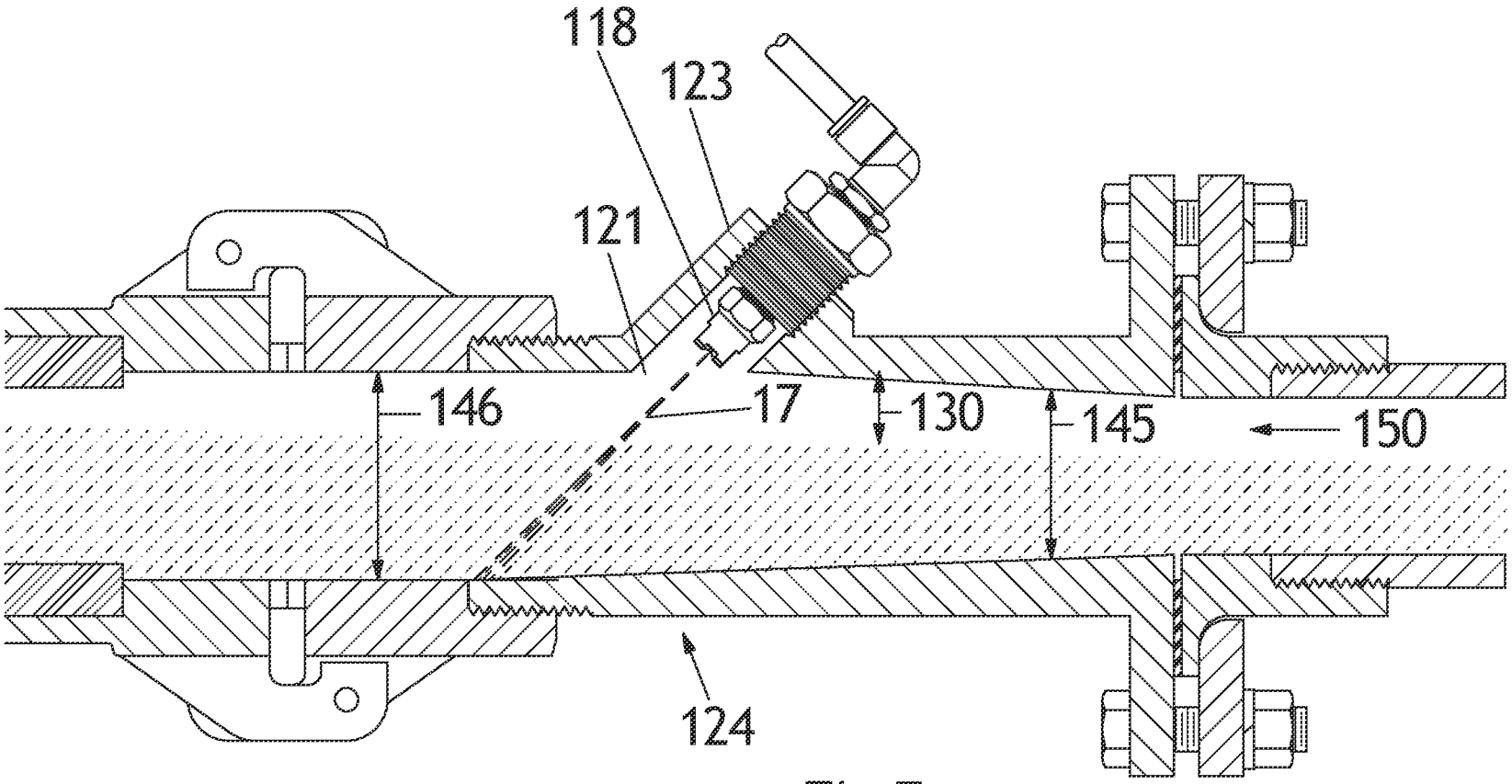
FIG. 7 is similar to FIG. 6 with a tapered transition expanding diameter flow chamber in the release nozzle.

Alternative configurations of the conduit system 114 and 124 are shown in enlarged, partial views FIGS. 6 and 7. The only distinction between these views is that the water injection conduit 124 of FIG. 6 is of constant diameter 142, whereas the water injection conduit 124 of FIG. 7 is of increasing diameter, as shown as 145 and 146. The difference in these two configurations is for the purpose of showing two ways of preventing gravity backflow. FIG. 6 uses a step up, immediate transition between IDs 142 and 143. FIG. 6 illustrates the water injection conduit 124 coupled with the blast hose 12 via respective flanges 31, 31*a*. FIG. 7 shows a tapered transition between the two IDs 145 and 146.

Figure 8:
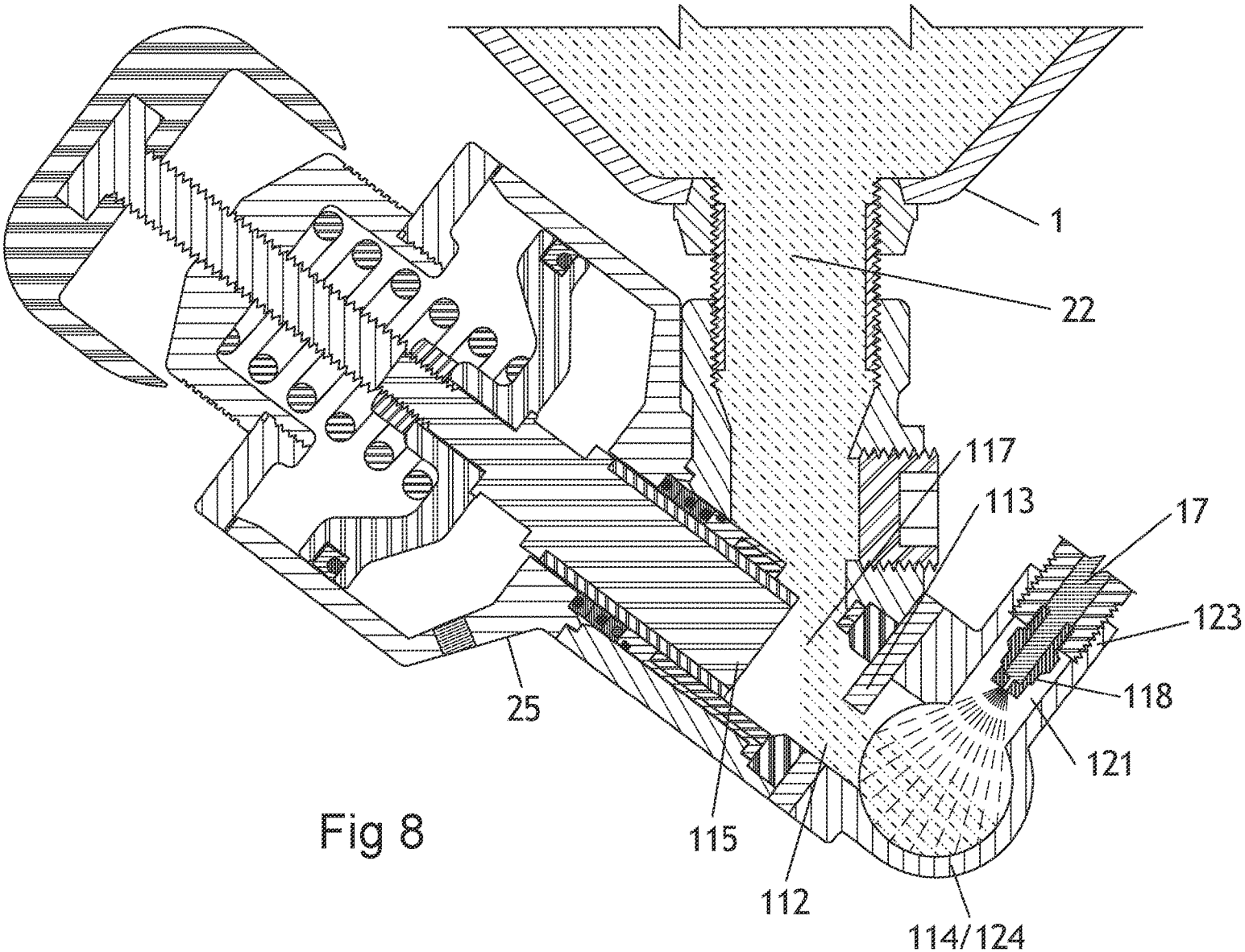
FIG. 8 is a longitudinal sectional view showing the connection of a typical metering valve to the system in communication with the abrasive control gate, the abrasive storage tank and the water injector (Air flow is perpendicular to the drawing surface).

FIG. 8 is a sectional view a typical metering valve 25 connected to the media delivery system of the subject invention. The media 22 stored in the tank 1 is released through the outlet 117 of the media valve 25, in well-known manner. The position of the plunger 115 in the valve 25 controls the size of the opening 117. The media 22 flows through the media release orifice 112 created by the presence of the media release orifice plate 113. The orifice plate 113 is secured to the outlet end of the media control valve 25. The media release orifice 112 is shaped such that the media flow is directed downward toward the bottom of the flow conduits (e.g., 114), leaving an air gap along the top of the conduits, as previously stated, and as clearly shown at 130 in FIGS. 5-7.

Specifically, the abrasive media release orifice 112 is shaped and positioned to optimize water spray coverage and minimize abrasive flow into the injection space thus mitigating water nozzle clogs. This controls the shape and location of the abrasive flow as it is released from the metering valve 25 in order to tighten or reduce the area and volume of the abrasive flow before it enters into the blast air stream. The shaped and tightened abrasive flow is maintained at the lower portion of the blast air stream. This positions the abrasive flow in optimum placement for spray wetting the abrasive as it flows into and through the water injection conduit section 124 housing the water release nozzle 118. This also mitigates nozzle clogging by directing most of the abrasive flow stream away from the water spray nozzle port 123, more clearly shown in FIGS. 6 and 7.

Figure 5:
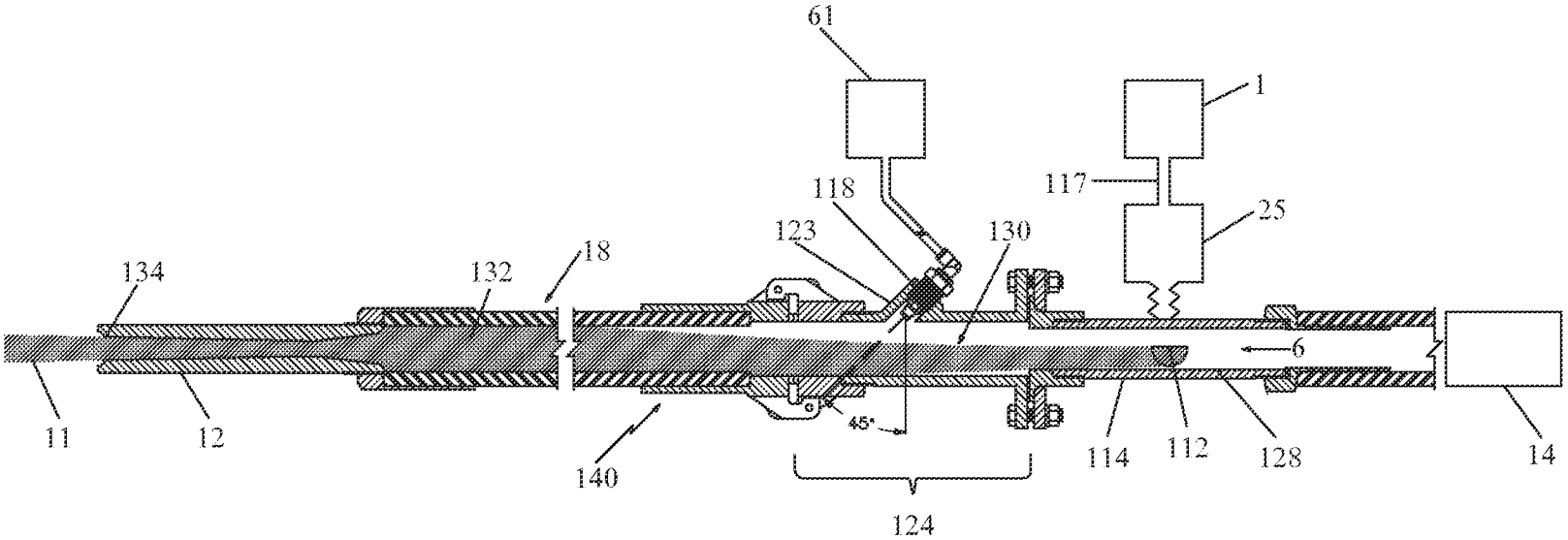
FIG. 5 is a longitudinal 9 (axial) sectional view of the air supply line, media control gate mounted on a typical media control valve, the water injector, and the release nozzle.

As best shown in FIG. 5, the water injection system is unique and novel in that instead of providing uniform media flow past the water injector nozzle 118, the media flow is partially deflected away from the water outlet, permitting the water 17 to flow into and more fully saturate the flow channel. This promotes more uniform mixing of the media 22 and water 17 and has the added advantage of creating a space between the water injector nozzle 118 and the dry media, reducing the tendency to clog the injection nozzle 118, particularly at low pressure operation when the media 22 can back flow toward the water injector nozzle 118. The media release orifice plate 113 is provided below the metering valve 25 and above the blast air conduit bottom surface 128 for directing the media stream away from the water injector nozzle 118. This keeps the nozzle 118 from being clogged and provides more clear space in the water injection conduit 124 for better distribution of the water 17.

The water spray chamber 121 is positioned out of the main flow stream, see FIGS. 6 and 7. The water spray port 123 or chamber 121 is placed such to keep it out of the main flow stream and angled to use the air flow inertia to keep abrasive and dust away from the injection or spray nozzle 118. This feature prevents gravity backflow to abrasive feed port 112. The tapered internal diameter and the step down internal diameter are both placed upstream of the water injection nozzle 118 and downstream of the abrasive feed port. Specifically, the ID of the blast air port where the abrasive is fed is smaller than the ID of the blast airport where the water 17 is injected. The enlarged ID is then maintained downstream through the blast hose 18. This prevents residual water from flowing upstream or any gravity back flow to where the abrasive is introduced into the blast air stream, which would eventually clog and stop the abrasive flow altogether. The difference in ID, whether tapered or stepped, is the primary feature that prevents gravity back flow of water that may accumulate in the injection area.

Figure 9:
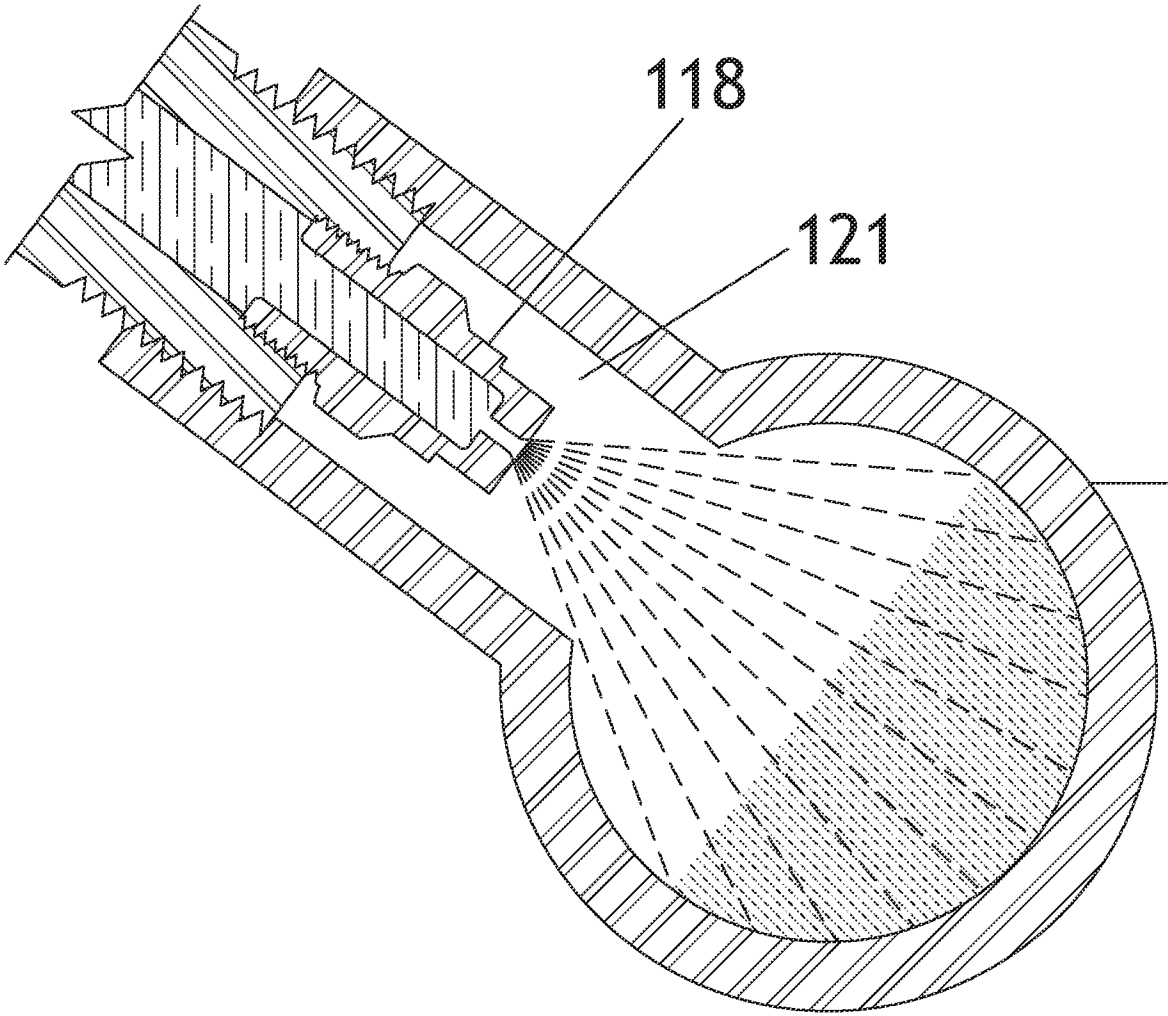
FIG. 9 is an enlarged partial view of FIG. 8 and shows the abrasive flow placement and water injection features of the invention.

The water spray nozzle 118 is placed inside a port or conduit 123 that intersects the blast air-line at an oblique angle rather directly perpendicular to the abrasive flow. The water spray angle follows general direction of blast air flow for efficiency. A forty-five degree angle has been found to operate at optimum efficiency. However, the specific angle used is a matter of choice depending of operation and application. The angled spray port 123 is smaller in diameter than the water infection conduit 124 (FIG. 5) in order to use the main air stream flow momentum to keep the abrasive from contacting the spray nozzle. The blast air flow directs the grit and dust away from the spray nozzle, minimizing or even eliminating clogs. As best shown in FIG. 9, the spray nozzle 118 is placed sufficiently within the spray port to further decrease the likelihood of abrasive contact with the water spray nozzle 118. The radial orientation of the water spray nozzle relative to the abrasive feed orientation allows optimum effectiveness for wetting the abrasive.

Figure 10:
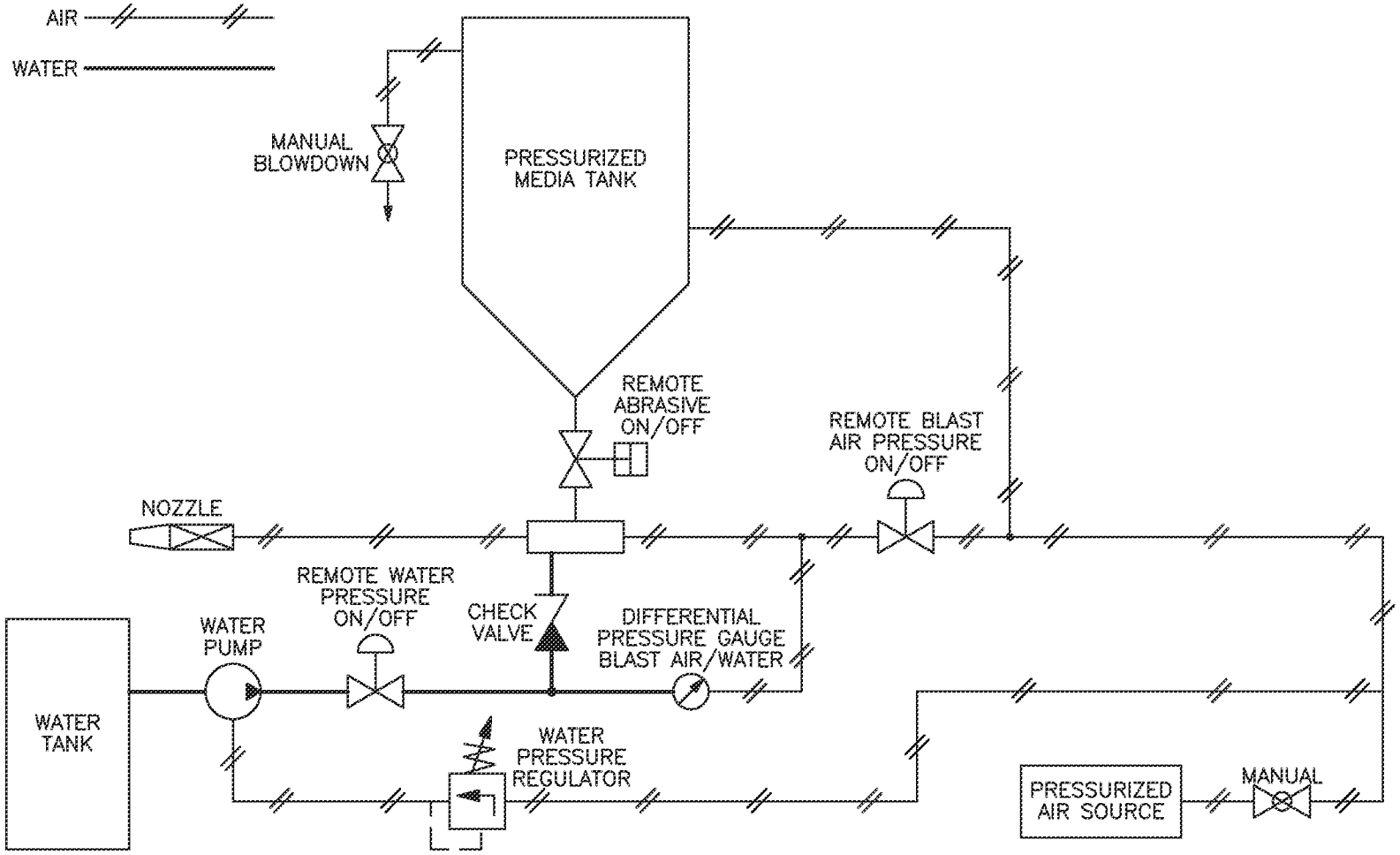
FIG. 10 is a circuit diagram for controlling the flow of abrasive, air and water in the system.
Figure 11:
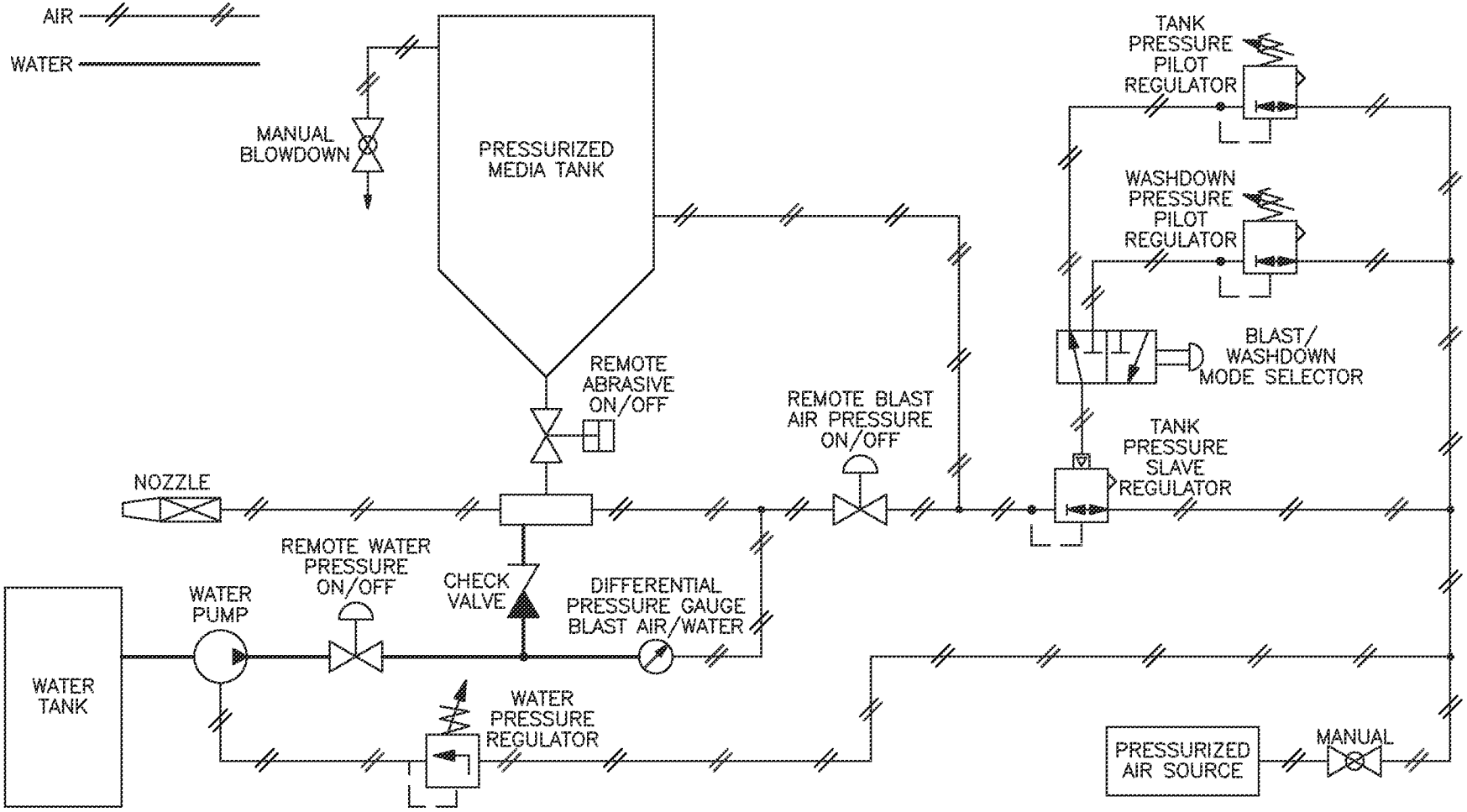
FIG. 11 is similar to FIG. 10 with the addition of a washdown circuit and a blowdown circuit.
Figure 12:
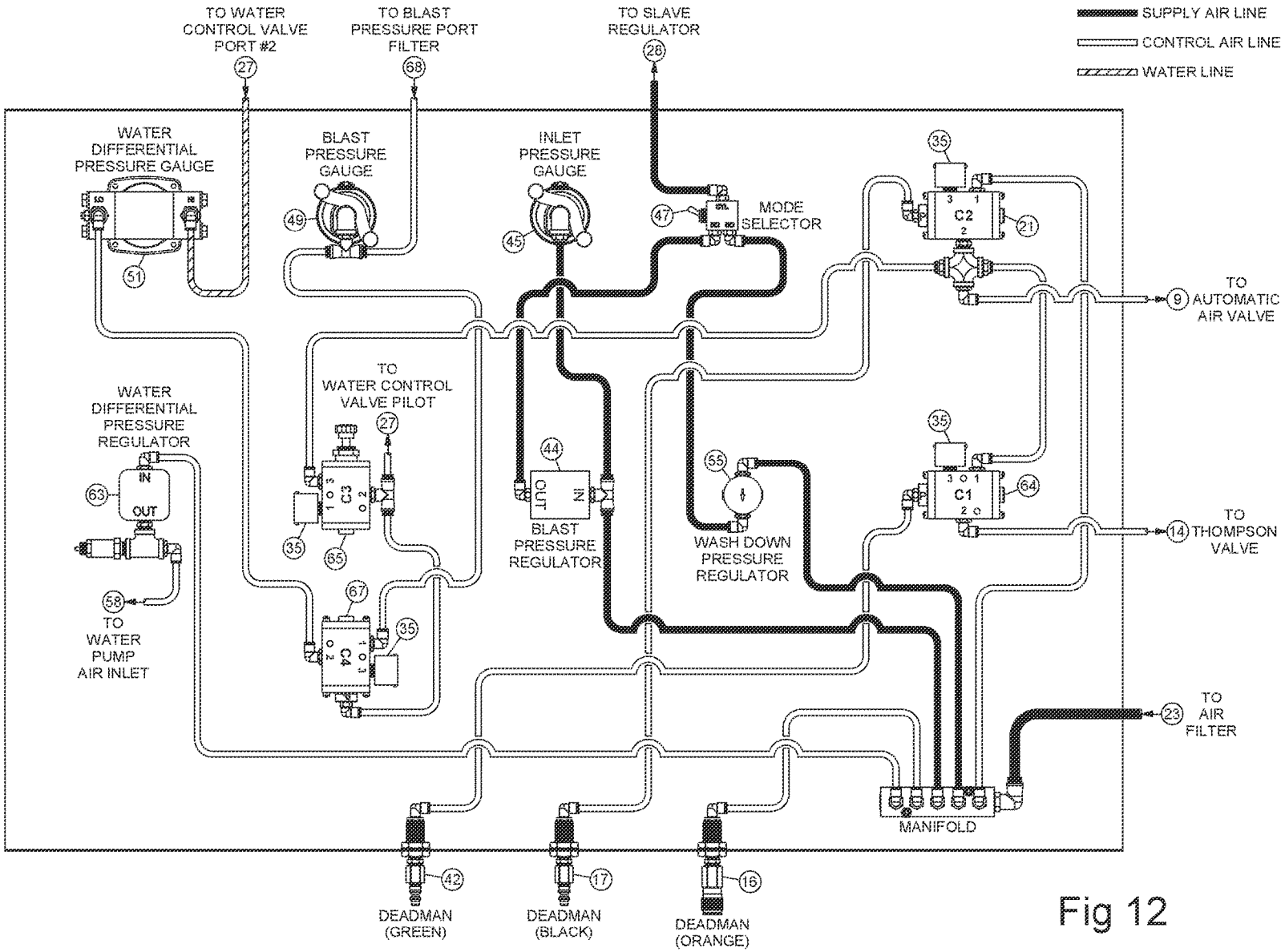
FIG. 12 is an outlet panel schematic simplified for purposes of clarity.

As shown in FIGS. 10-12, two unique features of the invention are the development of a new water injection delivery system and a control system that permits better control of the air/water mix during operation. As previously discussed, and consistent with the schematics shown in FIGS. 10-12, in the subject invention, the water pressure can be regulated, as well as the air pressure. This assures that the differential pressure between air pressure and water pressure can be accurately monitored and controlled. Because the water spray nozzle is a fixed opening, the operator can adjust either air or water pressure to increase or decrease the differential pressure between the two. This provides consistent and repeatable water flow control.

One advantage of this system is the ability to perform four separate operations using the same delivery and mix system and the same release nozzle. The customary wet blast operation can be performed using the air/media/water mixed controlled to the desired combination and pressure. Where desired, the media flow may be cut off, permitting a media free water rinse. In addition, the water may also be cut off, permitting the use of the pressurized air flow to function as a dryer. Further the system can be used in a standard dry blast mode.

The water injection system is unique and novel in that instead of providing uniform media flow past the injector, the media flow is partially deflected away from the water outlet, permitting the water to flow into and more fully saturate the release nozzle flow channel. This promotes more uniform mixing of the media and water and has the added advantage of creating a space between the water injector nozzle and the dry media, reducing the tendency to clog the nozzle, particularly at low pressure operation when the media can back flow toward the water injector nozzle. Specifically, a media release orifice is provided below the metering valve and above the main air stream for directing the media stream away from the water injector nozzle. This keeps the nozzle from being clogged and provides more clear space in the injector unit for better distribution of the water.

The water spray chamber is for preventing abrasives within the flow stream from contacting the spray nozzle. The tapered or stepped ID feature are for preventing gravity backflow from accumulation of residual water in the spray area or blast hose. The tapered internal diameter and the step down internal diameter are both placed upstream of the water injection point and downstream of the abrasive feed port. Specifically, the ID of the blast air port where the abrasive is fed is smaller than the ID of the blast air port where the water is injected. The enlarged ID is then maintained downstream through the blast hose. This prevents residual water from flowing upstream to where the abrasive is introduced into the blast air stream which would eventually wet and stop the abrasive flow altogether.

As discussed above, the differential pressure gage is positioned between water pressure and blast air pressure to visually indicate, quantify, and control water injection flow rate. The ability to have consistent, adjustable, and repeatable water flow control with a simple operation is a significant advantage over prior art dry blast based systems. In the exemplary embodiment, the differential pressure indicator is positioned to measure the difference between the water pressure and blast air pressure. Since water injection cannot be achieved unless the water pressure is greater than the blast air pressure. Typically, the spray nozzle is a fixed orifice, water flow rate is proportional to how much the water pressure is greater than the blast air pressure. This differential pressure gage reading provides the operator with a visual indication of volume flow rate. In addition, a water pressure regulator is provided for permitting the operator to adjust the water pressure. The pressure differential indicator and the water pressure regulator, in combination, provide the operator with the means to consistently and repeatedly control the water flow rate. Manually variable water flow is important because each operator will adjust the water flow according to the abrasive type, abrasive size, abrasive flow rate, dust content, blast pressure, and surface to be blasted.

An additional feature of the invention is the inclusion of a washdown circuit. After wetblasting, the surface is usually left with residual abrasive. This requires a rinse to wash the abrasive off the surface. The water flow rate for washdown is significantly higher than the water flow rate during blasting which is usually for dust control.

An additional feature may be a blowoff using compressed air to blow dry and ready the blasted surface for painting. This feature basically allows two setting of air pressure. One is for blasting which is generally greater than 80 psig. The washdown and blowoff would be at a much lower air pressure approximately 35 psig. This is achieved by allowing the operator to quickly select either pressure setting. If the water pressure regulator setting the same, significantly lowering the regulated air pressure will concurrently increase the water flow rate; thereby quickly creating a washdown mode. If the water flow is shutoff, this creates a lower pressure blowoff mode also. The washdown/blowoff circuit consists of two pilot air regulators and a slave regulator. A high-pressure blast pilot regulator and a washdown/blowoff pilot regulator are each ported to the much large and higher flow slave regulator. A three-way valve is placed between the two pilot regulators and slave regulator to allow the operator to manually select which pilot regulator controls the slave regulator.

While certain features and embodiments have been explained in detail herein, it should be understood that the invention encompasses all modifications and enhancements in accordance with the following claims.

What is claimed is:

1. A wet dry blast system comprising:

a source of pressurized air for providing a pressurized air flow;

a source of pressurized water for providing a pressurized water flow;

an abrasive media source to provide an abrasive media;

a water injection conduit configured to receive at least one of the pressurized air flow, the pressurized water flow, the abrasive media, and combinations thereof, to form a media mix therein;

a blast hose configured to convey the media mix received from the water injection conduit;

a blast nozzle coupled with the blast hose, and configured to release and deliver the media mix from the blast hose to a work surface; and a differential pressure gauge positioned between and in fluid communication with at least a portion of each of the pressurized water flow and the pressurized air flow in order to monitor the water pressure relative to the air pressure, and to provide an indication of a rate of the pressurized water flow.

2. The wet dry blast system of claim 1, the system further comprising a valve system for selectively disabling the source of pressurized water such that a dry mixture of pressurized air and abrasive media is delivered to the blast nozzle.

3. The wet dry blast system of claim 1, wherein the system is configured to disable the source of abrasive media such that only the pressurized water and the pressurized air is delivered to the blast nozzle.

4. The wet dry blast system of claim 1, wherein abrasive media is introduced into an abrasive release conduit downstream of the source of pressurized air and upstream of the source of pressurized water.

5. The wet dry blast system of claim 4, wherein the abrasive media is introduced into the pressurized air flow before the pressurized water flow is introduced.

6. The wet dry blast system of claim 1, the system further comprising:

a water inlet chamber which is positioned outside of the water injection conduit and in communication therewith; and a water release nozzle in the water inlet chamber, whereby the water release nozzle is spaced from and does not come in direct contact with an interior of the water injection conduit.

7. The wet dry blast system of claim 6, wherein the water inlet chamber is on an oblique angle relative to the water injection conduit.

8. The wet dry blast system of claim 1, wherein an interior cross-sectional area of the water injection conduit has a larger interior diameter at a downstream end and a smaller interior diameter at an upstream end.

9. The wet dry blast system of claim 1, the system configured to provide four separate modes of operation, the system further comprising:

a. a first mode operable to form and to provide a wet media mixture for wet blasting;

b. a second mode wherein only the source of abrasive media and the source of pressurized air are activated to provide a dry abrasive delivery for dry blasting;

c. a third mode wherein only the source of pressurized air is activated to provide an air-only drying system; and d. a fourth mode wherein only the source of pressurized water is activated to provide a water-only rinse.

10. The wet dry blast system of claim 9, wherein the first mode and the second mode are operable with at least 80 psig air pressure, and wherein the third mode and the fourth mode are operable at less than 35 psig air pressure.

11. The wet dry blast system of claim 1, wherein the blast hose has a first blast hose end coupled with the water injection conduit and a second blast hose end coupled with the blast nozzle, wherein there is a media release orifice configured to introduce the abrasive media into an abrasive release conduit and into the pressurized air flow from the pressurized air source, and wherein the pressurized water source introduces water into the water injection conduit downstream of the media release orifice for generating the media mix for release into the blast hose, and eventually out of the blast nozzle.

12. The wet dry blast system of claim 11, wherein a size of the media release orifice is determined by a restrictor.

13. The wet dry blast system of claim 11, wherein an interior diameter of the water injection conduit at the point of water injection is larger than another interior diameter of the abrasive release conduit at the point where the abrasive media is introduced from the media release orifice.

14. A wet dry blast system comprising:

a source of pressurized air for providing a pressurized air flow;

a source of pressurized water for providing a pressurized water flow;

an abrasive media source to provide an abrasive media;

an abrasive release conduit for receiving the abrasive media;

a water injection conduit downstream of the abrasive release conduit, the water injection conduit configured to receive at least one of the pressurized air flow, the pressurized water flow, the abrasive media, and combinations thereof, to form a media mix therein;

a water injection nozzle oriented to inject the pressurized water flow into the water injection conduit;

a blast hose configured to convey the media mix received from the water injection conduit;

a blast nozzle coupled with the blast hose, and configured to release and deliver the media mix from the blast hose to a work surface; and a differential pressure gauge positioned between and in fluid communication with at least a portion of each of the pressurized water flow and the pressurized air flow in order to monitor the water pressure relative to the air pressure to provide an indication of a rate of the pressurized water flow, whereby the abrasive media is introduced into the pressurized air flow before the pressurized water flow is introduced.

* * * * *